US010446064B2

(12) United States Patent
Saito

(10) Patent No.: US 10,446,064 B2
(45) Date of Patent: Oct. 15, 2019

(54) LIGHT EMITTING DEVICE FOR DESIGN

(71) Applicant: DAIKAN CO., LTD., Osaka-shi, Osaka (JP)

(72) Inventor: Akio Saito, Osaka (JP)

(73) Assignee: DAIKAN CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 15/525,256

(22) PCT Filed: Nov. 12, 2014

(86) PCT No.: PCT/JP2014/005676
§ 371 (c)(1),
(2) Date: May 8, 2017

(87) PCT Pub. No.: WO2016/075723
PCT Pub. Date: May 19, 2016

(65) Prior Publication Data
US 2018/0286294 A1 Oct. 4, 2018

(51) Int. Cl.
*G09F 7/14* (2006.01)
*G09F 13/04* (2006.01)

(52) U.S. Cl.
CPC ..... *G09F 13/0404* (2013.01); *G09F 7/14* (2013.01); *G09F 13/0413* (2013.01); *G09F 2013/0418* (2013.01)

(58) Field of Classification Search
CPC ..... G09F 13/0404
(Continued)

(56) References Cited

U.S. PATENT DOCUMENTS 3,755,943 A * 9/1973 Cesarotti ..... G09F 13/0404 40/552
4,986,017 A * 1/1991 Eckert ..... G09F 7/08 40/618

(Continued)

FOREIGN PATENT DOCUMENTS

JP 198130377 3/1981
JP 200772053 A 3/2007

(Continued)

OTHER PUBLICATIONS

International Search Report and Written Opinion, International Patent Application No. PCT/JP2014/005676, Jan. 13, 2015, with English translation of Search Report ( 8 pages).

*Primary Examiner* — Joanne Silbermann
(74) *Attorney, Agent, or Firm* — Hamre, Schumann, Mueller & Larson, P.C.

(57) ABSTRACT

Provided is a light emitting device 1 for design, the device capable of achieving a light emission surface 3 having esthetic effects without being influenced by a fixation structure between a light design part 4 and a housing 6. The light emitting device 1 for design includes: a light design part 4 having a light emission surface 3 either in a shape representing one of a character, a figure, and a pattern, or in a shape inverted therefrom, and the light design part being configured either to transmit or to diffuse light; a light source 9 configured to apply light to the light design part 4 from a back side of the light emission surface; and a housing 6 having an opening 6*c* following the shape of the light design part 4, and supporting the light design part 4 and the light source 9, wherein a support plate 5 that is either transparent or translucent is provided, the support plate 5 having one end bonded to either an edge or a portion near the edge of the light design part 4, and another portion fixed to the housing.

7 Claims, 5 Drawing Sheets

(58) Field of Classification Search
USPC ..... 40/552
See application file for complete search history.

(56) References Cited

U.S. PATENT DOCUMENTS

| | | | | |
|---|---|---|---|---|
| 5,444,929 | A * | 8/1995 | Joseloff | G09F 1/10 40/622 |
| 6,202,333 | B1 | 3/2001 | Grate et al. | |
| 2001/0042330 | A1 | 11/2001 | Grate et al. | |
| 2002/0104241 | A1 | 8/2002 | Grate et al. | |
| 2003/0079388 | A1* | 5/2003 | Schmitt | G09F 13/0413 40/552 |
| 2004/0111937 | A1 | 6/2004 | Grate et al. | |
| 2010/0064559 | A1* | 3/2010 | Dal Cavaliere | B26F 1/3813 40/545 |

FOREIGN PATENT DOCUMENTS

| | | | |
|---|---|---|---|
| JP | 2007232971 | A | 9/2007 |
| JP | 5514374 | B1 | 6/2014 |
| WO | 2013084453 | A1 | 6/2013 |

* cited by examiner

LIGHT EMITTING DEVICE FOR DESIGN

TECHNICAL FIELD

The present invention relates to a light emitting device for design used for an illuminated signage for a shop name or a logo, and an illuminated advertisement.

BACKGROUND ART

Conventionally, there have been provided light emitting devices for design that are referred to as illuminated signages for showing shop names and logos brightly, or illuminated advertisements. A light emitting device for design of this type shows a design such as a shop name and a logo brightly by diffusing light from a light source through a front panel to emit diffusive light. As such light emitting devices for design provide high visibility and esthetic effects, these devices are used in various places, for example, in front of or at an entrance of a brand-name store to show a name of its brand.

Such light emitting devices for design have started from conventional neon lighting and changed to recent LED signs using LEDs, and a variety of designs are demanded.

Here, there is proposed a box-shaped text signboard where a display area is maximized (cf. Patent Literature 1). Such a box-shaped text signboard is configured such that a side edge of a side-plate part of a housing is flexed, a circumference edge of a display part made of a material such as an acrylic material is brought into contact with the side-plate part of the housing, and a surface of the display part is brought into contact with the side edge of the housing to be fixed. With this, it is considered that a flange-like member that is brought into contact with the surface of the display part is not necessary.

However, such a shape always includes a metallic side edge of the housing outside the display part, and it is not possible to provide a design in which an entire surface from an anterior view constitutes the display part.

CITATION LIST

Patent Literature

Patent Literature 1: JP-A-2007-72053

SUMMARY OF THE INVENTION

Technical Problems

In view of the above problem, an object of the present invention is to provide a light emitting device for design, the device capable of achieving a light emission surface having esthetic effects without being influenced by a fixation structure between a display part and a housing.

Solution to Problems

The present invention is characterized by a light emitting device for design including: a light design part having a light emission surface either in a shape representing one of a character, a figure, and a pattern, or in a shape inverted therefrom, and the light design part being configured either to transmit or to diffuse light; a light source configured to apply light to the light design part from a back side of the light emission surface; and a housing having an opening following the shape of the light design part, and supporting the light design part and the light source, wherein a support plate that is either transparent or translucent is provided, the support plate having one end bonded to either an edge or a portion near the edge of the light design part, and another portion fixed to the housing.

Advantageous Effects of Invention

According to the present invention, it is possible to provide a light emitting device for design, the device capable of achieving a light emission surface having esthetic effects without being influenced by a fixation structure between a display part and a housing.

DESCRIPTION OF EMBODIMENTS

Figure 6:
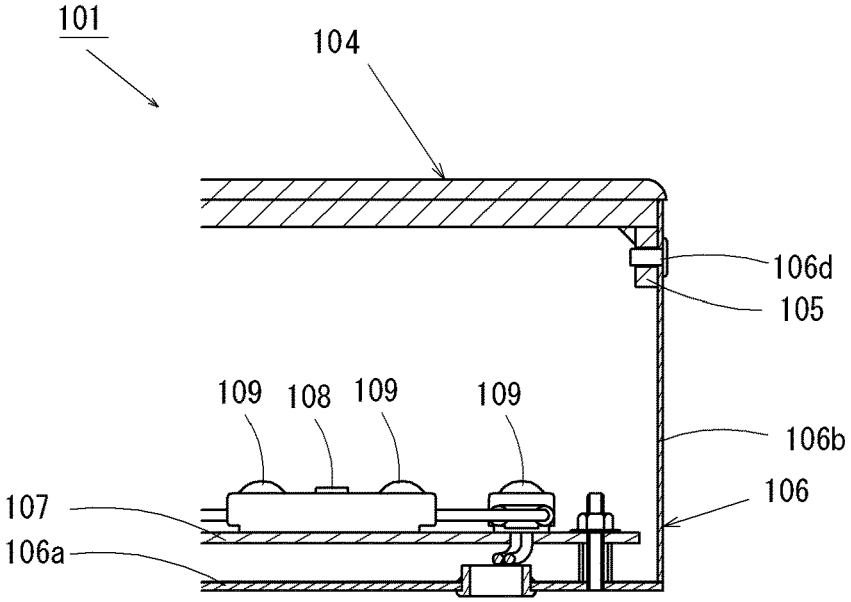
FIG. 6 shows a partially enlarged cross-sectional view illustrating a light emitting device for design before the present invention.

As shown by a light emitting device 101 for design illustrated in FIG. 6, the inventor of the present invention has first provided a light design part 104 capable of covering an edge of a housing 6 to make an entire surface into a light emission surface. Then, in order not to have the light design part 104 be shadowed by the supporting part 105, a supporting part 105 made of a transparent acrylic material is bonded to the light design part 104, and a screw 106*d* that fixes a housing 106 and the supporting part 105 is also made of a transparent material. However, there is a problem that even if these parts are transparent, a light shadow can be seen when viewed from a front surface.

Next, the inventor has come to an idea of making the supporting part 105 thin in order to eliminate shadow. However, when giving this idea a try, making the supporting part 105 thin also reduces an area of the bonded part, and this leads to a problem that the bonded part is easily separated as the acrylic material of the light design part 104 expands and contracts due to heat from an interior light source, heat from sunlight in the case of outdoor installation and the like. This proves that commercialization by making the supporting part 105 thin is difficult, and the inventor has studied a different way to eliminate shadow.

Then, the inventor has come to an idea of increasing the bonded area between the light design part 104 and the supporting part 105 by providing a backward recession by taking a side part of the light design part 104 so that the supporting part 105 is inserted into the backward recession. However, when giving this idea a try, this has a problem that the supporting part 105 may become damaged as the acrylic material of the light design part 104 expands and contracts due to heat from an interior light source, heat from sunlight in the case of outdoor installation and the like. Thus, the inventor has reached the same conclusion that commercialization by making the supporting part 105 thin is difficult.

As described above, making the supporting part 105 thin produces such problems as poor bonding and damages, and therefore attempts have been made such as reducing a number of screwing as much as possible, and screwing at less conspicuous positions even if there is shadow.

As a result of intense efforts in such circumstances to contrive a solution, by making the support plate 105 thin and using an elastic material, the inventor has successfully provided a light emitting device for design with which shadow is less conspicuous and that is not easily damaged.

Hereinafter, one embodiment of the present invention will be described with reference to the drawings.

Embodiment 1

While the light emitting device for design of the present invention may be applied to various characters, figures, and patterns, a description for Embodiment 1 takes a character "D" in a roman type which is one of serif typefaces as an example.

Figure 1:
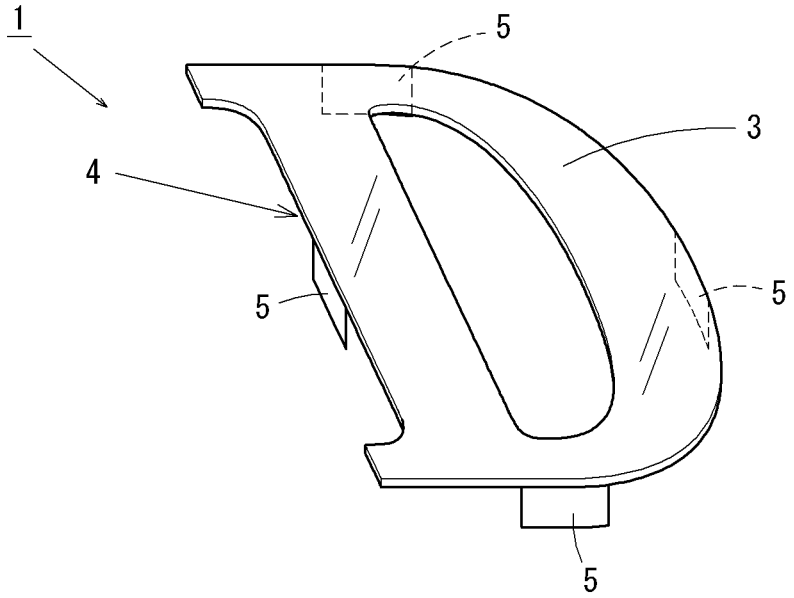
FIG. 1 shows an exploded perspective view of a light emitting device for design from an anterior bottom-left view.
Figure 1:
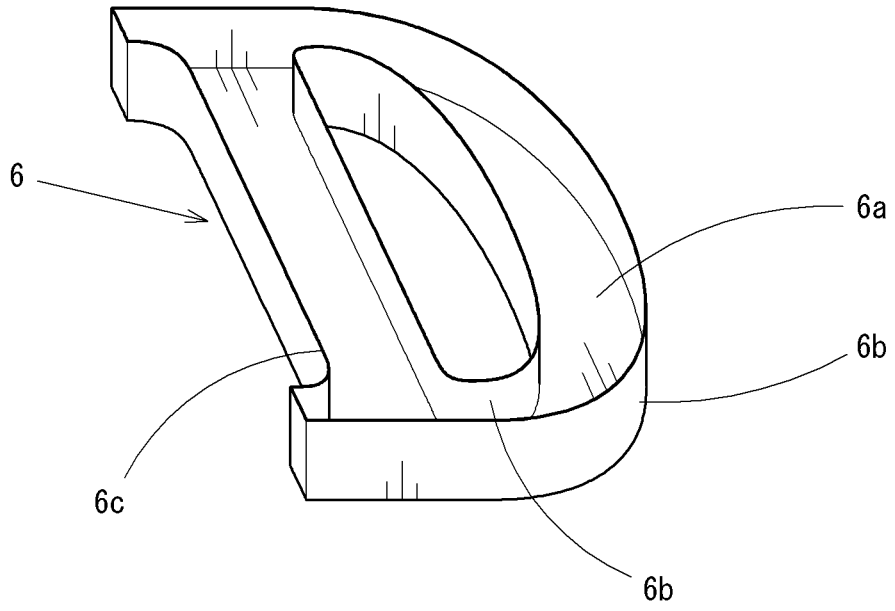
Figure 2:
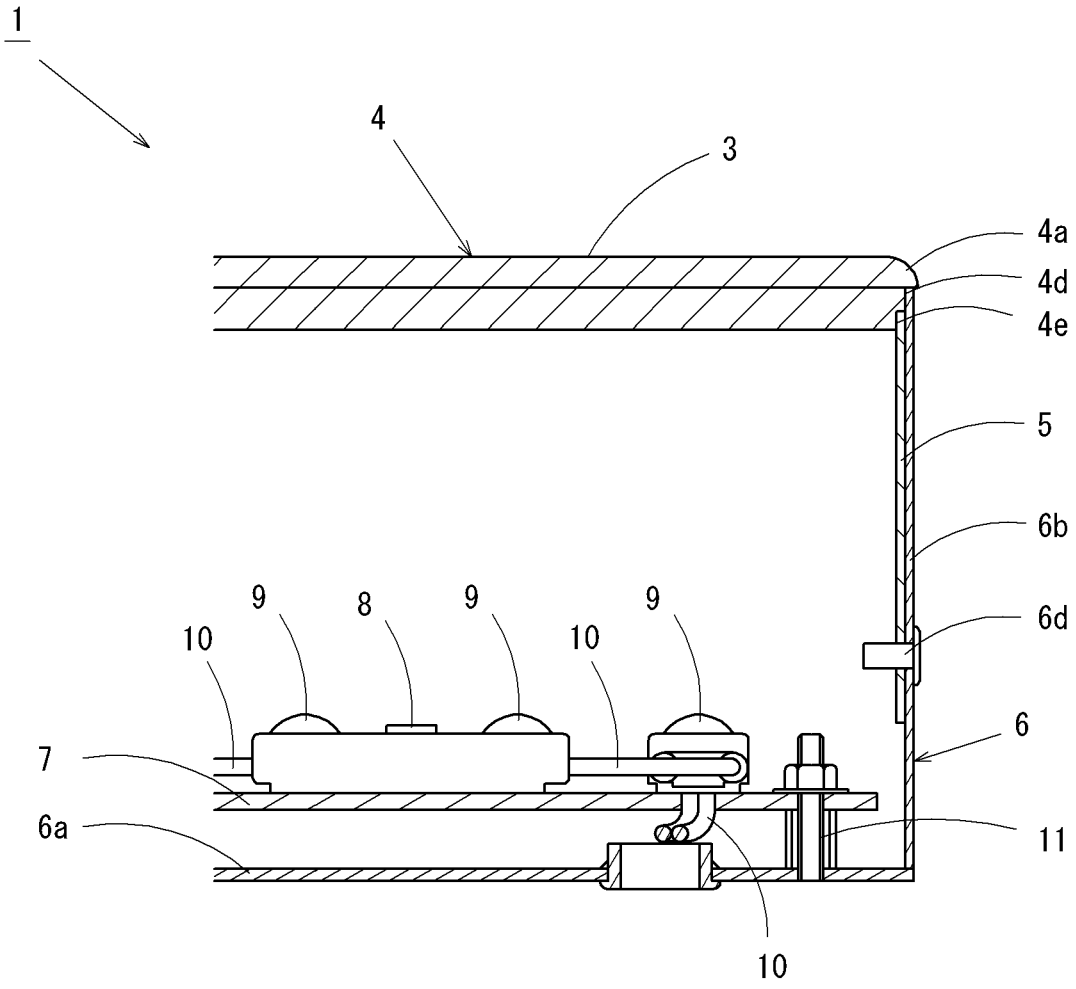
FIG. 2 shows a partially enlarged cross-sectional view across the light emitting device for design with its portion partially enlarged.

FIG. 1 is an exploded perspective view of a light emitting device 1 for design from an anterior bottom-left view, and FIG. 2 is a partially enlarged cross-sectional view across the light emitting device 1 for design with its portion partially enlarged. Here, in FIG. 1, members relating to electricity including a light source are not illustrated.

As illustrated in FIG. 1, the light emitting device 1 for design is mainly constituted by a light design part 4 and the housing 6.

The light design part 4 is in a plate-like shape having a surface cut in a shape of a character, a figure, or a pattern as the light emission surface 3. In Embodiment 1, a light emission surface 3 is formed in a "D" shape.

The light design part 4 is made of a milky white (translucent white) acrylic plate. It should be noted that the light design part 4 is not limited to an acrylic plate, and may be a plate-like member of an appropriate material that diffuses or transmits light, such as a glass plate or a plastic plate. Further, the light design part 4 may be transparent, and preferably translucent.

While the light design part 4 of this embodiment is configured by a single acrylic plate, it is possible to employ a configuration in which a front-side surface is configured by a transparent and light-transmitting plate (light-transmitting panel), and a back-side surface is configured by a translucent diffuser plate (diffuser panel).

The light design part 4 has chamfered parts 4*a* where a corner of an edge on a front side is rounded in an arc-like shape. While the chamfer is in the arc-like shape in this embodiment, the chamfer may be in a tapered shape where the corner is linearly chamfered.

The edge along a circumference of the light design part 4 has a backward recessed edge 4*d* on a back side (a bottom side in FIG. 2) that is slightly recessed backward from the front side. The backward recession 4*d* may take ¼ or more of a thickness of the light design part 4, preferably from ¼ to ¾, and more preferably from ⅓ to ⅔. Further, the backward recession 4*d* may preferably be such that a heightwise length (longitudinal length in FIG. 2) is longer than an across-the-width length (lateral length in FIG. 2), preferably one-and-a-half times as long or longer, and more preferably twice as long or longer. The backward recessed edge 4*d* is provided along a circumferential shape of the light design part 4 so as to have constant height and width along an entire circumference of a support plate 5. A side part 6*b* of the housing 6 is brought into contact with an outer side of the backward recessed edge 4*d*.

Further, the light design part 4 has a supporting backward recessed edge 4*e* where the back side (the bottom side in FIG. 2) of the backward recessed edge 4*d* is further recessed. The supporting backward recessed edge 4*e* may take ¼ or more of a thickness of the backward recession 4*d*, preferably from ¼ to ¾, and more preferably from ⅓ to ⅔, and is ½ in this embodiment. Further, the supporting backward recessed edge 4*e* may preferably be such that a heightwise length (longitudinal length in FIG. 2) is longer than an across-the-width length (lateral length in FIG. 2), preferably one-and-a-half times as long or longer, and more preferably twice as long or longer. The supporting backward recessed edge 4*e* is provided along the circumferential shape of the light design part 4 so as to have constant height and width along a length of or longer than the support plate 5. The support plate 5 is bonded and fixed to the outer side of the supporting backward recessed edge 4*e*.

The light design part 4 serves as a design part that constitutes a character, a figure, or a pattern. Further, the front side (front surface) of the light design part 4 serves as a light-emitting surface that emits light and provides visual contact by light transmitted from the back side to the front side.

The support plate 5 is formed in a plate-like shape. A thickness of the support plate 5 is preferably thinner than the thickness of the light design part 4, more preferably thinner than a half of the thickness of the light design part 4, more preferably thinner than one third of the thickness of the light design part 4, and most preferably thinner than a quarter of the thickness of the light design part 4. In this embodiment, the thickness of the support plate 5 is 1.0 mm, where the thickness of the light design part 4 is 8.0 mm.

A heightwise length (Longitudinal length in FIG. 2) of the support plate 5 is shorter than a height of the side part 6*b* of the housing 6, but longer than a height of the side part 6*b*, and is 15 mm in this embodiment. An across-the-width length (depthwise length in FIG. 2) of the support plate 5 may be any appropriate length according to a number of the support plates 5, is preferably longer than the heightwise length of the support plate 5, and is 30 mm in this embodiment.

The material for the support plate 5 may be made of a resin such as polycarbonate, PVC (polyvinyl chloride), PET (polyethylene terephthalate), plastic, or acrylic, and preferably has the same or higher elasticity as or than that of the light design part 4. In this embodiment, the support plate 5 is made of polycarbonate. Further, it is preferable that the support plate 5 is made translucent or transparent, and provided with transmittance that is on the order of or higher than light transmittance of the light design part 4. In this embodiment, the support plate 5 is translucent milky white, that is, configured to be translucent of the same type of color as and on the order of the light transmittance of the light design part 4.

As illustrated in FIG. 1, the housing 6 is provided with a back-side part 6*a* having the same shape as that of the light design part 4, and the side part 6*b* with a constant depth, upright at right angle from a side end of the back-side part 6*a* to the front side. Therefore, the housing 6 is configured to be in a container shape having an opening 6*c* of the same shape as that of the light design part 4 on the front side, and defined by the side part 6*b* and the back-side part 6*a* except for the front side.

The housing 6 is made of a metallic member such as stainless steel or alloy. An interior of the housing 6 is applied with a glossy white coating (including white printing). The white coating serves as a reflecting surface that reflects light. Here, instead of the white coating, a white film may be provided.

As illustrated in FIG. 2, to the back-side part 6*a* of the housing 6, a substrate 7 is fixed by a screw 11. The substrate 7 is provided with a plurality of light sources 9. The illustrated light sources 9 are, but not limited to, LEDs connected to a circuit chip 8 to emit light, and light sources such as flexible substrates having neon tubes and light-emitting parts or light guide plates guiding light from light-emitting parts may be utilized as appropriate.

Further, the light sources 9 are connected via a line 10, and emit light with receiving electricity from a power source that is not illustrated.

With the light emitting device 1 for design thus configured, it is possible to prevent the support plate 5 and a screw 6*d* from shielding light from the light sources 9 and from casting shadow on the light design part 4, and thus to achieve the light emission surface 3 having esthetic effects without being influenced by a fixation structure between the light design part 4 and the housing 6.

To be more specific, as being translucent, the support plate 5 guides light from the light sources 9 in an appropriate manner to irradiate the light design part 4. Therefore, the support plate 5 may not shield light to cast shadow, and light emitted outside from the light design part 4 is made substantially uniform so as to represent a character, a figure, or a pattern that emits light brightly without shadow.

Further, partly because the white coating within the housing 6 serves as the reflecting surface, the light from the light sources 9 enters the light design part 4 and the support plate 5 as spread surface light, is then diffused within the light design part 4 and the support plate 5, and is emitted outside the light design part 4 as substantially uniform surface light.

Moreover, as the chamfered part 4*a* is provided at the corner of the side edge on a surface of the light design part 4, light diffused within the light design part 4 reaches outside the chamfered part 4*a*, and it is possible to emit light brightly to the edge of the light design part 4.

Furthermore, as the support plate 5 is made of an elastic material, and the light design part 4 is fixed to the housing 6 via the support plate 5 instead of being directly fixing, the support plate 5 may absorb expansion due to heat or the like and prevent damages. In addition, as the light design part 4 is fixed on one side of the support plate 5, and is fixed on the other side to the housing 6 by the screw 6*d*, it is possible to fully utilize elasticity of the support plate 5, and to prevent damages even when the light design part 4 expands and contracts to a large extent due to high heat.

Further, providing the supporting backward recessed edge 4*e* allows the support plate 5 to be firmly fixed to the light design part 4, and prevents the support plate 5 from being separated from the light design part 4.

The light emitting device 1 for design having an entire front surface be the light design part 4 in this manner while eliminating shadow allows unprecedented visual effects, and may be provided as a high-class light emitting device 1 for design.

The present invention is not limited to the configuration of the embodiment described above, and may provide various other embodiments.

FIGS. 3(A) to 3(F) show illustration of variations of the light design part 4 and a supporting part 5 of the light emitting device 1 for design by partially enlarged cross-sectional views, and FIGS. 4(A) to 4(H) show illustration of variations of a fixation part between the supporting part 5 and the housing 6 by partially enlarged views. Configurations not shown in the figures are the same as that in the embodiment described with reference to FIG. 1 and FIG. 2, and therefore like components are denoted by like reference numerals and detailed descriptions thereof shall be omitted.

Figure 3:
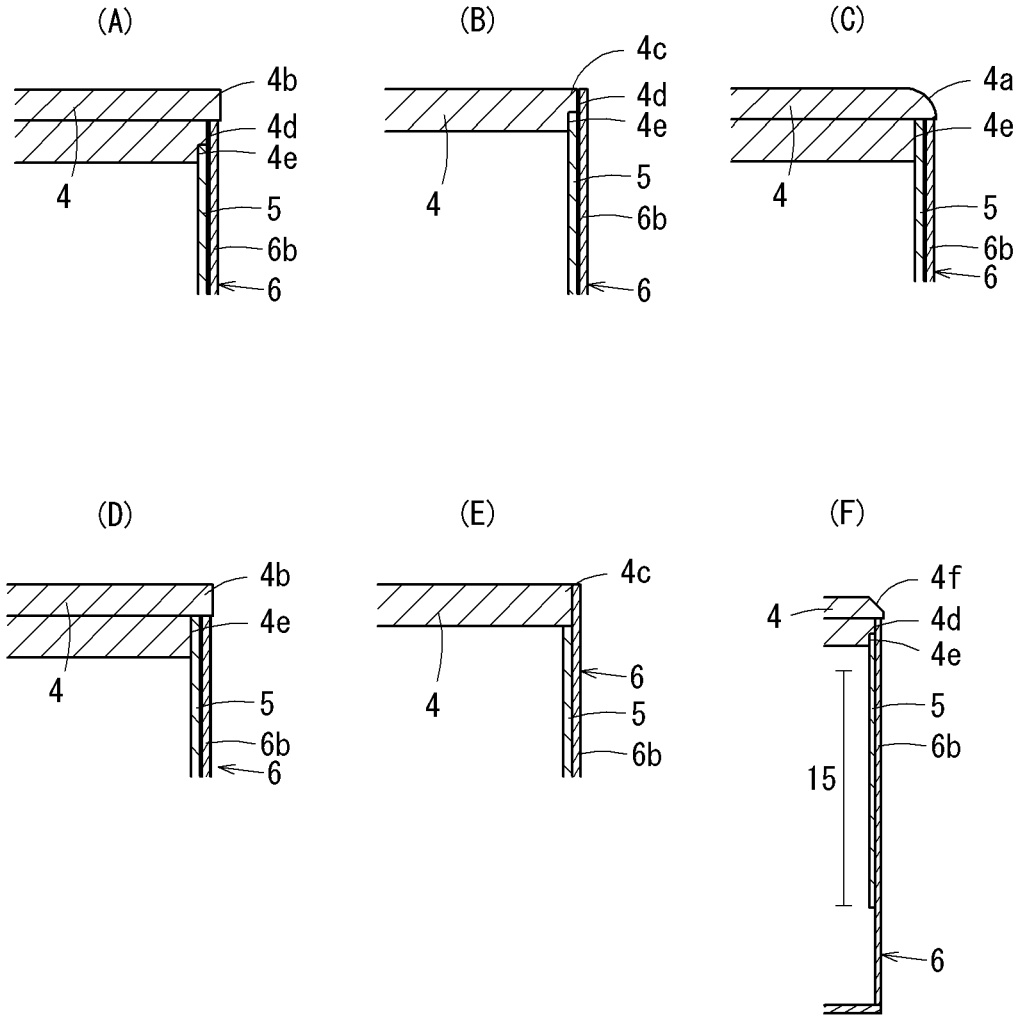
FIGS. 3(A) to 3(F) show illustration of variations of a light design part and a supporting part by partially enlarged cross-sectional views.

FIG. 3(A) shows Embodiment 2 in which the corner of the side edge of the surface of the light design part 4 is provided as a corner 4*b* without chamfering.

FIG. 3(B) shows Embodiment 3 in which the light design part 4 is made slightly thinner and smaller by eliminating a part projecting in a circumferential direction on the front side of the light design part 4 such that the light design part 4 is contained within the housing 6. In this case, an upper end of the housing 6 can be visually seen at the edge of the light design part 4 to provide an aesthetic effect that a character, a figure, or a pattern emitting light is bordered by a silver line.

FIG. 3(C) shows Embodiment 4 in which the backward recessed edge 4*d* of the light design part 4 is eliminated and the length of the supporting backward recessed edge 4*e* is increased. In this case, an upper end of the side part 6*b* of the housing 6 and an upper end of the supporting part 5 are aligned and are brought into contact with the back side of the part projecting outside the light design part 4.

FIG. 3(D) shows Embodiment 5 in which the chamfered part 4*a* in Embodiment 4 is provided as the corner 4*b* without chamfering.

FIG. 3(E) shows Embodiment 6 in which the supporting backward recessed edge 4*e* in Embodiment 3 is eliminated and the supporting part 5 is bonded to the back side of the light design part 4.

FIG. 3(F) shows Embodiment 7 in which a tapered chamfered part 4*f* where the chamfered part 4*a* in Embodiment 1 (cf. FIG. 2) is linearly chamfered instead of the arc-like shape, and the supporting part 5 is bonded to the side part 6*b* of the housing 6 by a bond agent instead of screwing. An area to which the bond agent is applied is a bonding area 15 mainly at a position distant from the light design part 4.

Figure 4:
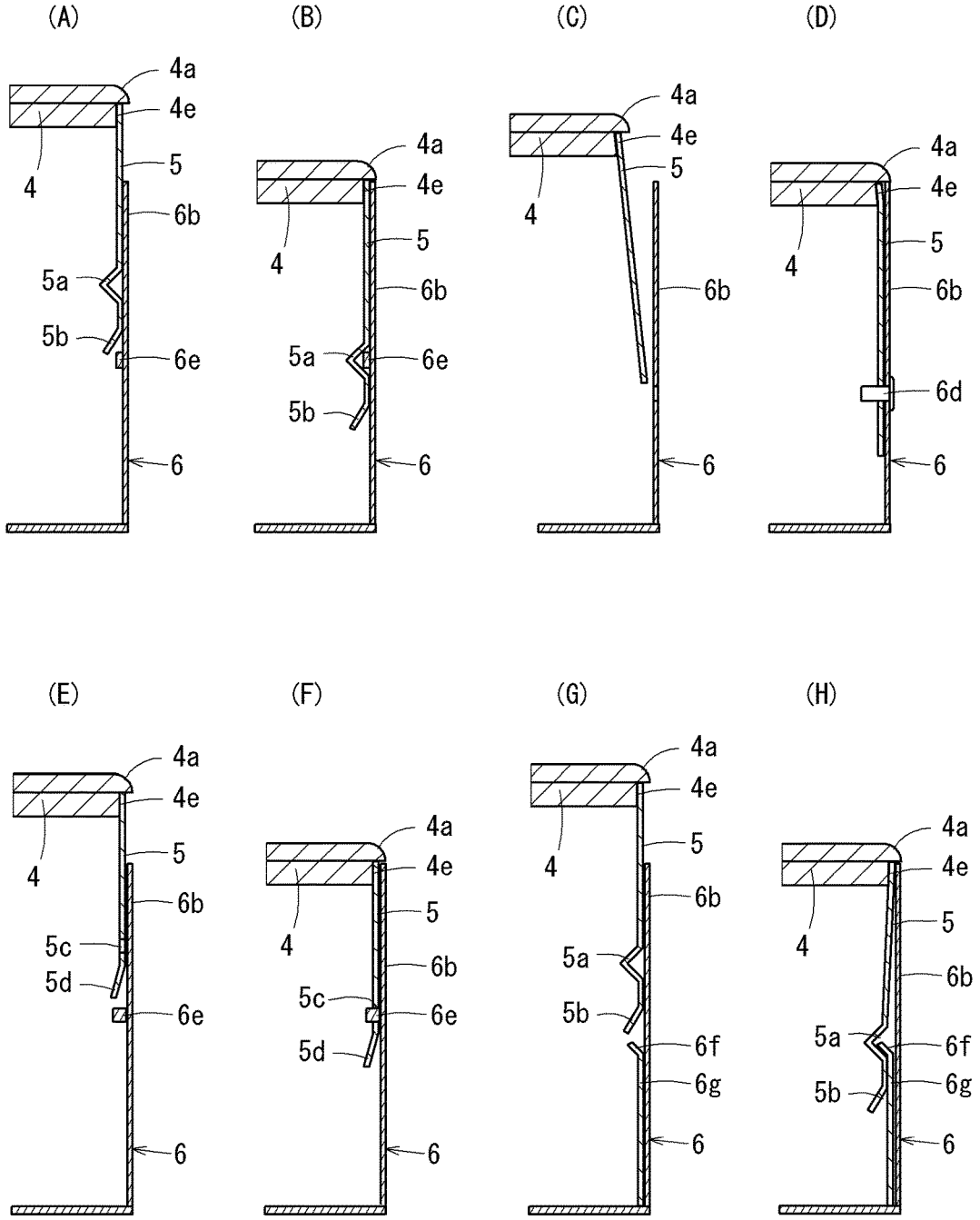
FIGS. 4(A) to 4(H) show illustration of variations of a fixation part between the supporting part and a housing by partially enlarged views.

FIGS. 4(A) and 4(B) show Embodiment 8 in which an edge of the supporting part 5 on the back side (edge that is most distant from the light design part 4) is flexed inwardly to provide a guiding part 5*b*, and a portion that is slightly closer to the light design part 4 than the guiding part 5*b* is flexed inwardly to project to provide a fixation part 5*a*. In this manner, it is possible to eliminate attachment work using a bond agent or the screw 6*d*, and it is possible to fix by a one-touch operation of inserting the supporting part 5 into the housing 6 from a state shown in FIG. 4(A) to a state shown in FIG. 4(B).

FIGS. 4(C) and (D) show Embodiment 9 in which the supporting backward recessed edge 4*e* in Embodiment 4 is made inclined so as to project to the back side or outside, instead of the front side. The light design part 4 and the supporting part 5 are pressed into the housing 6 from a state shown in FIG. 4(C), and the supporting part 5 and the housing 6 are fixed by the screw 6*d*. In this manner, as a force by the supporting part 5 pressing the housing 6 is added, the light design part 4 may not be easily separated from the housing 6. Here, the supporting part 5 and the housing 6 are fixed by the screw 6*d* in this Embodiment 9, but the screw 6*d* may be eliminated. Also in this case, it is possible to prevent the supporting part 5 from being separated from the housing 6 due to the pressing force.

FIGS. 4(E) and (F) show Embodiment 10 in which a fixation hole 5*c* is provided instead of the fixation part 5*a* in Embodiment 8. The light design part 4 and the supporting part 5 are pressed into the housing 6 from a state shown in FIG. 4(E), and the guiding part 5*b* provided on a lower end of the supporting part 5 gets over an attachment projection 6*e* provided within the side part 6*b*, and the attachment projection 6*e* is fitted into and fixed to the fixation hole 5*c* as illustrated in FIG. 4(F).

FIGS. 4(G) and (H) show Embodiment 11 in which an attachment member 6*g* having an attachment convex portion 6*f*, instead of the attachment projection 6*e* in Embodiment 8, is bonded within the side part 6*b* of the housing 6. The light design part 4 and the supporting part 5 are pressed into the housing 6 from a state shown in FIG. 4(G), and a guiding part 5*d* provided on the lower end of the supporting part 5 gets over an attachment projection 6*f* provided within the side part 6*b*, and the attachment projection 6*f* is fitted into and fixed to the fixation part 5*a* as illustrated in FIG. 4(H).

Figure 5:
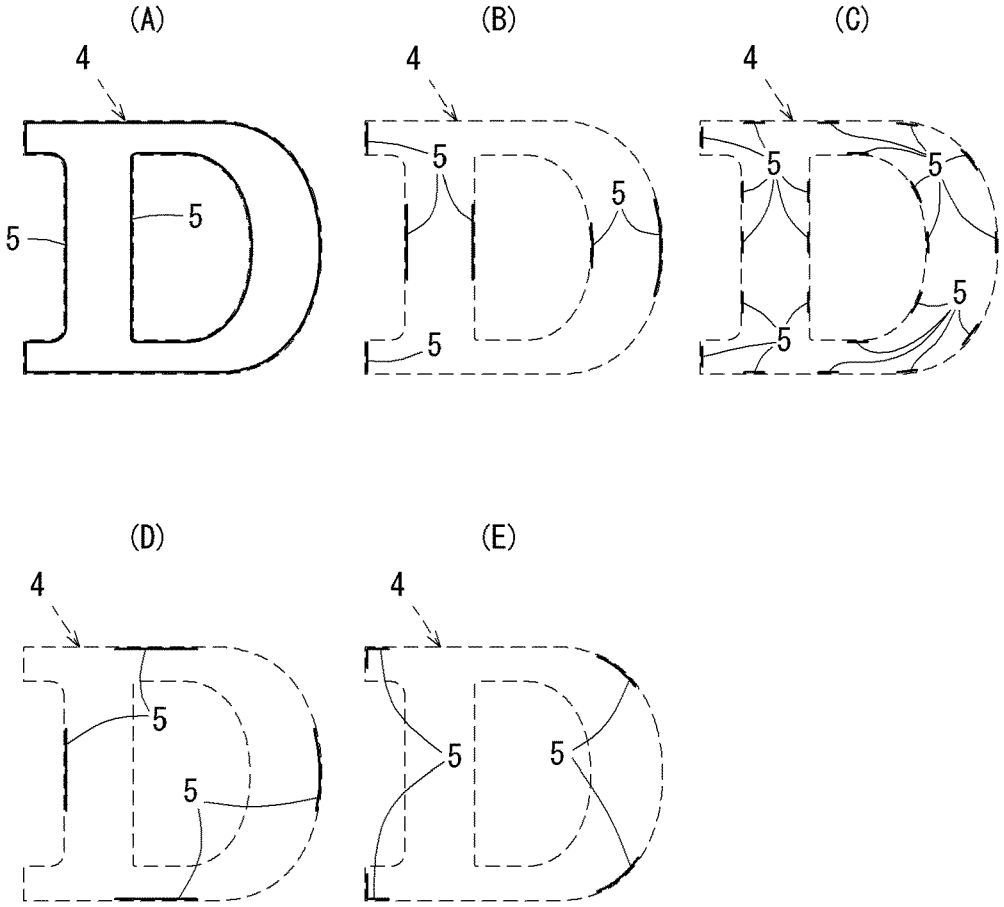
FIGS. 5(A) to 5(E) show illustration of variations of a position of the supporting part by front views.

FIG. 5(A) shows Embodiment 12 in which the supporting part 5 is provided along the edge of the light design part 4 over an entire circumference.

FIG. 5(B) shows Embodiment 13 in which the supporting parts 5 are provided at 6 positions along the edge of the light design part 4.

FIG. 5(C) shows Embodiment 14 in which the supporting parts 5 are provided at 22 positions along the edge of the light design part 4.

FIG. 5(D) shows Embodiment 15 in which the supporting parts 5 are provided at 4 positions along the edge of the light design part 4.

FIG. 5(E) shows Embodiment 15 in which the supporting parts 5 are provided at 4 positions along the edge of the light design part 4.

All of these Embodiment 2 to Embodiment 16 may also provide effects as described in Embodiment 1.

Shown is Embodiment 9 in which the supporting backward recessed edge 4*e* is made inclined so as to project to the back side or outside, instead of the front side. In this manner, as a force by the supporting part 5 pressing the housing 6 is added, the light design part 4 may not be easily separated from the housing 6. Here, the supporting part 5 and the housing 6 are fixed by the screw 6*d* in this Embodiment 9, but the screw 6*b* may be eliminated. Also in this case, it is possible to prevent the supporting part 5 from being separated from the housing 6 due to the pressing force.

While a gothic type and a star-shaped figure are used in Embodiment 1 to Embodiment 15, it is possible to use a serif typeface as shown in Embodiment 1. By contrast, it is possible to use a gothic type or a star-shaped figure in Embodiment 1.

Further, the supporting part 5 is assumed to be translucent, but may be transparent. In this case, a function of the supporting part 5 for guiding light is improved, and a portion where the supporting part 5 is present in the light design part 4 is shown brightly.

Moreover, although the light emitting device 1 for design is fixed to an installation surface such as a wall with the back-side part 6*a* of the housing 6 a bottom, the present invention is not limited to such an example, and the light design part 4 may be caused to face the installation surface by flipping sides and fixed with a slight distance from the installation surface. In this case, providing a left-right reversal shape of a character, a figure, or a pattern desired to be shown is favorable. With this, it is possible to achieve a design in which a portion around a character, a figure, or a pattern desired to be shown emits light when viewed from the front side (visual contact side), and to prevent surrounding light from being unnatural, as shadow of the support plate 5 is not cast.

Further, when the front and back sides are flipped in this manner, a transparent plate may be used for the light design part 4 instead of a diffuser plate. When a transparent plate is used, the light design part 4 of the light emitting device 1 for design may emits strongly light directly to the installation surface.

Moreover, the supporting backward recessed edge 4*e* to which the support plate 5 is bonded may have a shape appropriate to be provided along the entire circumference of the light design part 4, provided such that only the bonded part with the support plate 5 is recessed out of the circumference of the light design part 4, or provided so that an entire edge of the light design part 4 constitutes the supporting backward recessed edge 4*e*.

INDUSTRIAL APPLICABILITY

The present invention may be applied to illuminating devices formed in shapes such as three-dimensional characters called channel letters, and to illuminated signages for shop names and logos as well as to illuminated advertisements.

REFERENCE SIGNS LIST

1: Light emitting device for design
3: Light emission surface
4: Light design part
5: Support plate
6: Housing
6*c*: Opening

The invention claimed is:

1. A light emitting device for design, the device comprising:

a light design part having a light emission surface either in a shape representing one of a character, a figure, and a pattern, or in a shape inverted therefrom, and the light design part being configured either to transmit or to diffuse light;

a light source configured to apply light to the light design part from a back side of the light emission surface;

a housing having an opening following the shape of the light design part, and supporting the light design part and the light source; and a support plate that is either transparent or translucent, the support plate having one end bonded to either an edge or a portion near the edge of the light design part, and another portion fixed to the housing, wherein the housing is made of a metallic member and has a back-side part having a same shape as the shape of the light emission surface and a side part with a constant depth upright from a side end of the back-side part to a front side, the support plate has a heightwise length that is shorter than a height of the side part and is fixed to the housing at a position distant from the one end that is bonded to the light design part within the side part, and the support plate is configured to have a transmittance for transmitting light such that no shadow of the support plate is cast onto the light design part by light from the light source that is transmitted through the support plate and emitted from one end on a side of the light design part, or that one end of the support plate becomes brighter than the light design part.

2. The light emitting device for design according to claim 1, wherein the support plate is made thinner than the light design part.

3. The light emitting device for design according to claim 2, wherein the support plate is made of one of a material that is identical to a material for the light design part and a material that is more elastic than the light design part.

4. The light emitting device for design according to claim 1, wherein the support plate is made of one of a material that is identical to a material for the light design part and a material that is more elastic than the light design part.

5. A light emitting device for design, the device comprising:

a light design part having a light emission surface either in a shape representing one of a character, a figure, and a pattern, or in a shape inverted therefrom, and the light design part being configured either to transmit or to diffuse light;

a light source configured to apply light to the light design part from a back side of the light emission surface;

a housing having an opening following the shape of the light design part, and supporting the light design part and the light source, and a support plate that is either transparent or translucent, having one end bonded to either an edge or a portion near the edge of the light design part, and another portion fixed to the housing, wherein the support plate is made thinner than the light design part, the light design part has a supporting backward recessed edge having a back-side portion recessed backward so that a side of the light emission surface has a protruding portion, and one end of the support plate is in contact with a back surface of the protruding portion, and is bonded to the supporting backward recessed edge.

6. The light emitting device for design according to claim 5, wherein the support plate is made of one of a material that is identical to a material for the light design part and a material that is more elastic than the light design part, and the support plate is fixed to the housing at a position distant from the one end that is bonded to the light design part.

7. The light emitting device for design according to claim 5, wherein the support plate is configured to have a transmittance for transmitting light of such an extent either that no shadow of the support plate is cast onto the light design part by light from the light source that is transmitted through the support plate and emitted from one end on a side of the light design part, or that one end of the support plate becomes brighter than the light design part.

* * * * *